US005420561A

United States Patent [19]

Swensen

[11] Patent Number: 5,420,561

[45] Date of Patent: May 30, 1995

[54] BREAKER OR RESETTABLE FUSE DEVICE

[75] Inventor: Robert C. Swensen, Mt. Prospect, Ill.

[73] Assignee: Littlefuse, Inc., Des Plaines, Ill.

[21] Appl. No.: 184,876

[22] Filed: Jan. 21, 1994

[51] Int. Cl.[6] ..... H01H 37/54

[52] U.S. Cl. ..... 337/365; 337/368

[58] Field of Search ..... 337/70, 97, 100, 101, 337/102, 103, 104, 365, 367, 370, 372

[56] References Cited

U.S. PATENT DOCUMENTS

| | | | |
|---|---|---|---|
| 2,133,309 | 10/1938 | Schmidinger . | |
| 2,754,391 | 7/1956 | Prickett . | |
| 2,846,543 | 8/1958 | Sivacek . | |
| 3,004,203 | 10/1961 | Esptein . | |
| 3,131,271 | 4/1964 | Siiberg . | |
| 3,196,234 | 7/1966 | Broekhuysen . | |
| 3,361,890 | 1/1968 | Stoll | 337/100 |
| 3,483,360 | 12/1969 | Perry . | |
| 3,631,370 | 12/1971 | Hollis . | |
| 3,707,694 | 12/1972 | DuRocher . | |
| 3,893,055 | 7/1975 | Jost et al. . | |
| 3,961,300 | 6/1976 | Budlane | 337/100 |
| 4,837,545 | 6/1989 | Cobb, III et al. | 337/70 |

*Primary Examiner*—Lincoln Donovan
*Attorney, Agent, or Firm*—Wallenstein & Wagner Ltd.

[57] ABSTRACT

A resettable circuit breaker for protecting an electrical circuit from prolonged overload current conditions. The resettable breaker opens upon prolonged overload current conditions. With an optional resistor, the resettable breaker remains open until the prolonged overload current is removed from the breaker. The breaker comprises a first stationary terminal having a first contact, and a movable terminal comprised of a single metal and having a second contact for engagement, under normal conditions, with the first contact. A shape memory alloy wire is positioned adjacent the movable terminal. The shape memory alloy wire is normally in a relaxed, non-contracted configuration. Upon prolonged overload current conditions, the shape memory alloy wire is heated and contracts to contact and shift the movable terminal and the second contact out of engagement with the first contact.

7 Claims, 1 Drawing Sheet

BREAKER OR RESETTABLE FUSE DEVICE

BACKGROUND OF THE INVENTION

Currently, automotive fuses are designed to blow under either short-circuit conditions or prolonged overload conditions. Under short-circuit conditions in a circuit protected by a typical, current automotive fuse, an extremely high current can cause a break in a fusible element in a relatively short period of time. This break in the fusible element causes a disruption of the power supply to that circuit, protecting that circuit from the harmful effects of this high current.

Current automotive fuses also open their internal circuitry to cause a disruption in the power supply under prolonged overload current conditions. If, for example, a current of 135 percent of the rated capacity of the fuse flowed through the fuse for thirty (30) minutes or more, the fusible element of the fuse would blow. A drawback of such generally highly reliable fuses is that the breaking of their fusible element cannot be reversed. Once the fuse has blown, it must be discarded and replaced with a new fuse of the same rated capacity.

There are many examples of current circuit breakers, i.e., resettable fuse devices, on the market. These circuit breakers are disclosed in various United States patent, or are known through their apparent sale or distribution in the United States.

Patents disclosing these and other similar devices include U.S. Pat. Nos. 2,133,309, issued to Schmidinger on Oct. 18, 1938; 2,754,391, issued to Prickett on Jul. 10, 1956; 2,846,543, issued to Sivacek on Aug. 5, 1958; 3,004,203, issued to Epstein on Oct. 10, 1961; 3,131,271, issued to Siiberg on Apr. 28, 1964; 3,196,234, issued to Broekhuysen on Jul. 20, 1965; 3,483,360, issued to Perry on Dec. 9, 1969; 3,631,370, issued to Hollis on Dec. 28, 1971; 3,707,694, issued to DuRocher on Dec. 26, 1972; and 3,893,055, issued to Jost et al. on Jul. 1, 1975.

In addition, the Bussmann division of the McGraw-Edison Company, St. Louis, Mo., distributes and sells within the United States a bi-metal fuse. This bi-metal fuse includes a main element which is a composite of two different metals. This main element is normally bowed or flexed in one direction. When the main element is heated, as occurs during current overload conditions, the differences in the expansivity of the two metals causes the main element to snap into a second, bowed position that is opposite to the first, normal bowed position. In this second, bowed position, the circuit breaker opens to interrupt the flow of current through both the breaker and the circuit that the breaker protects. Because this main element is made of two metals, it is believed to be subject to metal fatigue which can result in an increase in inaccuracy and calibration failure. Moreover, the main element flexes constantly while being heated, not suddenly as with the control wire of the present invention.

SUMMARY OF THE INVENTION

The invention is a resettable circuit breaker for protecting an electrical circuit from prolonged overload current conditions. The resettable breaker opens upon prolonged overload current conditions and, in one embodiment, remains open until the prolonged overload current is removed from the breaker. The breaker comprises a first stationary terminal having a first contact; a second stationary terminal; and a movable terminal, i.e., a deformable metal blade, electrically connected to the other of the pair of terminal blades. The movable terminal includes a single metal and has a second contact for engagement under normal current conditions, i.e., under non-prolonged overload current conditions, with the first contact on the first stationary terminal. A shape memory alloy wire is positioned adjacent the movable terminal. The shape memory alloy wire is normally in a relaxed, non-contracted configuration.

In one embodiment of the invention, a resistor is in electrical communication with both the first stationary terminal and the second stationary terminal. Upon prolonged current overload conditions, the shape memory alloy wire is heated, and contracts to shift the movable terminal and the second contact out of engagement with the first contact on the first stationary terminal. In the embodiment having the resistor, current flowing through the resistor upon these overload conditions creates sufficient heat to maintain the contraction of the shape memory alloy wire. In this way, the first contact is kept out of engagement with the second contact until the overload conditions are removed.

The resettable circuit breaker of this invention may also include a provision for circuit protection under short circuit conditions. Particularly, the breaker may include a fusible link connecting disparate portions of the first stationary terminal. Under short circuit conditions, this fusible link will separate, interrupting current flow through the breaker. When this happens, the circuit breaker must be replaced to provide circuit protection against subsequent short circuit conditions.

DETAILED DESCRIPTION OF THE PREFERRED EMBODIMENTS

Figure 1:
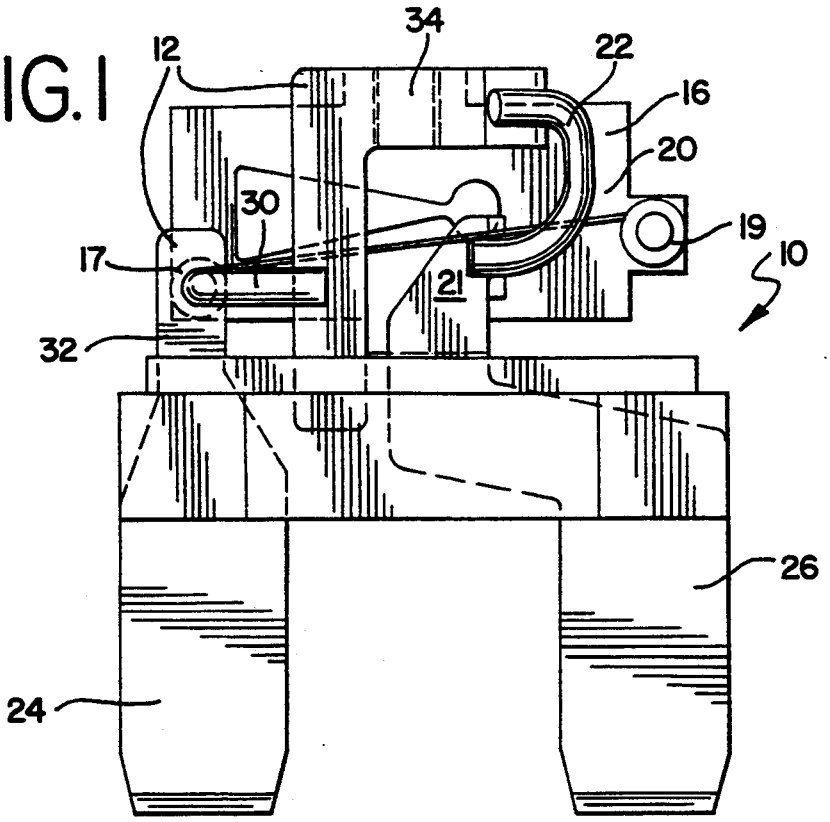
FIG. 1 is a side view of one preferred embodiment of the invention, but shown with an overcap removed.

While this invention is susceptible of embodiment in many different forms, there is shown in the drawings and will herein be described in detail two preferred embodiments of the invention. It is to be understood that the present disclosure is to be considered as an exemplification of the principles of the invention. This disclosure is not intended to limit the broad aspect of the invention to the illustrated embodiment.

Figure 2:
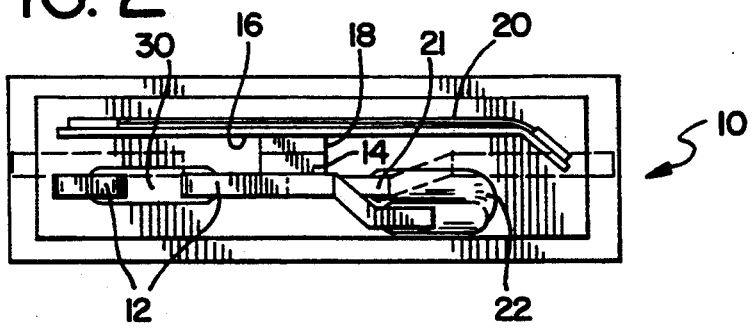
FIG. 2 is a top view of the circuit breaker of the embodiment of FIG. 1, shown with the overcap in place and partially in section, and with the movable terminal and first stationary terminal in their normal, contacting condition.
Figure 3:
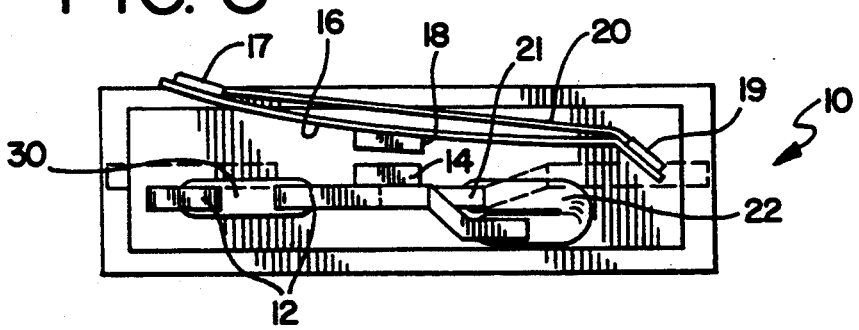
FIG. 3 is a top view of the circuit breaker of the embodiment of FIG. 2, but with the movable terminal and first stationary terminal in a somewhat exaggerated depiction of their spaced-apart condition.

One preferred embodiment of the present invention is shown in FIGS. 1–3. This circuit breaker shown in the FIGURES is intended to replace large, high current-rated, plug-in, blade-type fuses, such as the MAXI TM fuse currently sold by Littelfuse, Inc., Des Plaines, Ill., the assignee of the present invention. The circuit breaker is intended for protecting an external electrical circuit (not shown) having a given normal circuit resistance from prolonged overload current conditions when that circuit resistance is lowered to an unsafe level.

As may be generally seen in the side view of FIG. 1, the invention is a resettable circuit breaker 10 for protecting that electrical circuit from such prolonged overload current conditions. For example, in the event that the current through the circuit protected by circuit breaker 10 exceeds 135 percent of the rated current of that breaker 10 for a period in excess of thirty (30) minutes, the breaker 10 is designed to open. The circuit breaker is shown in this open position in FIG. 3. The extent of movement of the movable terminal 16, i.e., the deformable metal blade 16, has been exaggerated in this FIG. 3, however, for illustrative purposes. In fact, in actual operation, this movable terminal or deformable metal blade 16 stays within the physical confines of its overcap or housing 28.

The resettable breaker 10 opens to the position shown in FIG. 3 upon these and other prolonged overload current conditions, and in one embodiment remains open until the prolonged overload current is removed from the breaker. Thus, if the breaker remains in the overloaded circuit, and the source of the overload is not removed, the breaker continues to remain open. If the source of the overload is removed, then the breaker resets or closes to its position as shown in FIG. 2, and is then again ready to begin functioning in a normal manner. The source of the overload can be removed by either taking the breaker out of the circuit, by correcting the overload, or by removing the source of the overload from the circuit. Under any of these conditions, the breaker will reset.

As may be seen in FIGS. 1-3, the breaker 10 includes a first stationary terminal 12. This first stationary terminal 12 may be relatively thin, and may be made from any conductive metal. Preferably, the first stationary terminal 12 may be made of two parts. These parts are indicated as parts 32 and 34 in FIG. 1. First stationary terminal 12 has a first contact 14, as may best be seen in FIGS. 2 and 3.

The breaker 10 also includes a movable terminal 16, which is also comprised of a single, electrically conductive metal. Movable terminal 16 is preferably a snap-action, deformable metal blade. Movable terminal 16 carries a second contact 18 for engagement under normal current conditions, i.e., under non-prolonged overload current conditions depicted in FIG. 2, with the first contact 14 of the first stationary terminal 12.

A second stationary terminal 21 is also provided. As will be explained below for one of the two preferred embodiments of the invention, this second stationary terminal 21 may be secured by a resistor to the first stationary terminal 12 to ensure that some current will pass through the device, even when the first contact 14 and second contact 18 of the device have become disengaged.

A shape memory alloy wire 20, or control wire, is positioned adjacent the movable terminal 16. The preferred shape memory alloy wire 20 is made of nickel and titanium, and may also be made of nickel, titanium, and palladium. The nickel-titanium wire is sold under the trade name FLEXINOL TM by Dynalloy, Inc., 18662 MacArthur Boulevard, Suite 103, Irvine, Calif. 92715, (714) 476-1206. The wire used in the current embodiment has a diameter of 0.006 inches, a resistance of 1.23 ohms per inch, and a maximum pull force of 641 grams. The length of this wire 20 varies with its temperature.

As may best be seen in FIG. 2, the shape memory alloy wire 20 is normally positioned adjacent the movable terminal 16 in a relaxed, non-contracted configuration. The ends of this wire 20 may be secured to the movable terminal 16 by wrapping portions of that wire 20 around the ends of the movable terminal 16, or around rivets 17 and 19 secured to the ends of the movable terminal 16.

Upon prolonged overload current conditions, such as a current at 135 percent of the rated capacity of the breaker 10 for a maximum period of thirty (30) minutes, the movable terminal 16 is heated beyond the temperature experienced under normal conditions. As a result, the shape memory alloy wire 20 is heated by the high temperature, adjacent movable terminal 16. When the shape memory alloy wire 20 reaches a certain control temperature, it contracts, i.e., shortens, significantly and in a sudden manner. Thus, this ,control wire 20 has a length which varies sharply with its temperature. This is unlike wires made of more conventional metals which would normally expand upon a steady increase in temperature and in a predictable, relatively constant manner. Due to this sudden contraction, the distance between rivets 17 and 19 is decreased, causing the movable terminal 16 to flex in the manner shown in FIG. 3. As a result, the shape memory alloy wire 20 shifts the movable terminal 16 and the second contact 18 out of engagement with the first contact 14. Essentially, control wire 20 forces the movable terminal 16 to flex away from its normal position, as shown in FIG. 2, to a contracted position as shown in FIG. 3.

In summary, in the unstressed state of the movable terminal 16, the second contact 18 is engaged with the first contact 12. Under these normal external circuit resistance conditions, this engagement establishes electrical continuity between the terminal blades 24 and 26. The contacts, which are electrically connected to these terminal blades 24 and 26, separate if an abnormally low resistance condition persists for a given period of time.

As indicated above, and as may be seen in FIG. 3, in this contracted position, the movable terminal 16 causes the second contact 18 to move away from its normal engagement with the first contact 14. This movement opens the breaker 10 and stops most of the flow of current through the protected circuit.

A resistor or heat generating element 22 is in electrical communication with both the first stationary terminal 12 and the second stationary terminal 21. During normal operating conditions, as shown in FIG. 2, the resistance of this heat generating element or resistor 22 far exceeds the small resistance of parallel, conductive components in the internal circuit of the breaker. These parallel components include the first stationary 12 terminal and the movable terminal 16, and their respective contacts 14 and 18. Accordingly, under these normal operating conditions, most of the current passing through the circuit breaker 10 passes through the stationary 12 and movable terminals 16. Because its resistance is of a value such that little current passes through the resistor 22 under normal operating conditions, negligible heat is generated by this resistor 22 under such conditions.

When the breaker 10 is opened because contacts 14 and 18 are disengaged, as shown in FIG. 3 and as occurs under prolonged moderate overload conditions, the resistor 22 enables a small, non-harmful amount of current to flow through the first stationary terminal 12 and the second stationary terminal 21 of the breaker 10, and thus through the protected circuit. The high resistance value of this resistor 22 ensures that under any possible anticipated overload conditions, only a small amount of current will pass through the breaker 10 and its protected circuit. For a circuit breaker 10 rated at 50 amperes, the value of this resistor 22 is sixty (60) ohms.

Under the overload conditions of FIG. 3, and with contacts 14 and 18 separated, current passes through the resistor 22. The amount of current passing through resistor 22 at any time is small. However, during these overload conditions, the current passing through the resistor 22 exceeds the amount of current passing through resistor 22 during normal, non-overload conditions. Moreover, even the relatively small amount of leakage current flowing solely through the resistor 22 during overload conditions generates heat.

Generally, the entire breaker 10, except for the terminal blades 24 and 26, will be enclosed within an overcap or housing 28. These terminal blades 24 and 26 connect the resettable circuit breaker, in series, with the protected, external electrical circuit. Terminal blade 24 is electrically connected with the first or stationary contact 14, and terminal blade 26 is indirectly electrically connected to the other or second contact 18. Terminal blade 26 is also electrically connected with the second stationary terminal 21.

This housing 28, which is made of a polyester and is preferably opaque, has a tendency to retain heat created by the resistor 22. In fact,, the retained heat that is created by the passage of this leakage current through the resistor 22 is sufficient to maintain the shape memory alloy wire 20 above the temperature at which it will contract. Thus, even though the contacts 14 and 18 have separated, opening the protected circuit and eliminating the first stationary terminal 12 and movable terminal 16 as sources of heat, the memory alloy wire 20 remains contracted and keeps the contacts 14 and 18 in the non-engaged state shown in FIG. 3.

When the overload conditions are removed, the current through the resistor 22 drops to a point where the heat generated by that resistor 22 is insufficient to maintain the wire 20 in its contracted state. As a result, the wire 20 returns to its normal, relaxed state and the movable terminal 16 returns to the position shown in FIG. 2. Thus, as may be seen in this FIG. 2, the first 14 and second contact 18 become reengaged after removal of the overload conditions.

As indicated above, the housing 28 is preferably made of a polyester. Many polyester or similar materials would be suitable. However, the preferred polyester material is known as Rynite 545, a product of the E. I. DuPont de Nemours & Co.

The resettable circuit breaker 10 of this invention may also include a provision for protection of the circuit under a short circuit condition. Particularly, the breaker 10 may include a fusible link 30 connecting portions 32 and 34 of the first stationary terminal 12. Under short circuit conditions, the fusible link 30 will break, interrupting current flow through the breaker 10. When this happens, the circuit breaker 10 is unusable, and must be replaced to again provide protection against such short circuit conditions.

Another aspect of the invention is a circuit breaker virtually identical to that shown in FIGS. 1–3, differing only by the absence of the resistor 22. In such an embodiment, the breaker will open upon overload conditions, just as occurs with the embodiment of FIGS. 1–3. However, without the resistor 22, there is no path for the passage of leakage current through the device when the contacts 14 and 18 have been separated.

With no resistor 22, and thus no current flowing through a resistor 22, there is no heat build-up within a resistor 22 and thus no means of maintaining heat on the control wire 20 after the contacts 14 and 18 have separated. As a result, the control wire 20 contracts soon after separation of the contacts 14 and 18, the tension on the movable terminal 16 is removed, and the movable terminal 16 flexes back into the position of FIGS. 1 and 2, wherein the contacts 14 and 18 become re-engaged. If, upon such re-engagement, the overload condition has not been eliminated from the circuit, then the control wire 20 will again cause the movable terminal 16 and its contact 18 to move away from the first stationary terminal 12 and its contact 14. This relatively rapid cycle of repeated disengagement and re-engagement will continue indefinitely in this second embodiment, until the source of the overload has been removed from the circuit or the breaker has been removed from the circuit.

While the specific embodiments have been illustrated and described, numerous modifications come to mind without significantly departing from the spirit of the invention, and the scope of protection is only limited by the scope of the accompanying Claims.

What I claim is:

1. A resettable circuit breaker for protecting an electrical circuit from prolonged overload current conditions, said resettable breaker opening upon said prolonged overload current conditions and remaining open until said prolonged overload current conditions are removed from said breaker, said breaker comprising:

a. a first stationary terminal having a first contact;

b. a movable terminal comprised of a single metal and having a second contact for engagement, under non-prolonged overload current conditions, with said first contact;

c. a second stationary terminal;

d. a shape memory alloy wire positioned adjacent said movable terminal, said shape memory alloy wire normally being in a relaxed, non-contracted condition; and e. a resistor in electrical communication with both said first stationary terminal and said second stationary terminal;

wherein upon said prolonged overload current conditions, said shape memory alloy wire is heated and contracts, thereby contacting and shifting said movable terminal and said second contact out of engagement with said first contact of said first stationary terminal, and whereby current flowing through said resistor upon said overload conditions creates sufficient heat to maintain the contraction of said shape memory alloy wire and to thereby keep said first contact out of engagement with said second contact until said overload conditions are removed.

2. The resettable circuit breaker of claim 1, further comprising a fusible link connecting separate portions of said first stationary terminal.

3. A resettable circuit breaker for protecting an electrical circuit from prolonged overload current conditions, said resettable breaker opening upon prolonged overload current conditions and remaining open until said prolonged overload current is removed from said breaker, said breaker comprising:

a. a first stationary terminal having a first contact;

b. a movable terminal comprised of a single metal and having a second contact for engagement, under non-prolonged overload current conditions, with said first contact;

c. a shape memory alloy wire positioned adjacent said movable terminal, said shape memory alloy wire normally being in a relaxed, non-contracted condition;

d. a second stationary terminal;

e. a resistor in electrical communication with both said first stationary terminal and said second stationary terminal; and f. a fusible link connecting portions of said first stationary terminal;

wherein upon said prolonged overload current conditions, said shape memory alloy wire is heated and contracts to contact and shift said movable terminal and said second contact out of engagement with said first contact of said first stationary terminal, and whereby current flowing through said resistor upon said overload conditions creates sufficient heat to maintain the contraction of said shape memory alloy wire and to thereby keep said first contact out of engagement with said second contact until said overload conditions are removed.

4. In a circuit breaker for protecting an external electrical circuit having a given normal circuit resistance from a prolonged overload current condition when said circuit resistance is lowered to an unsafe level, said circuit breaker comprising:

a. a pair of terminal blades for connecting said circuit breaker in series with said external electrical circuit;

b. a first stationary contact electrically connected to one of said pair of terminal blades;

c. a deformable metal blade electrically connected to the other of said pair of terminal blades and carrying a second contact which, in an unstressed state of the blade, engages with said first contact under normal external circuit resistance conditions to establish electrical continuity between said terminal blades, said contacts separating if an abnormally low resistance condition persists for a given period;

d. a control wire made of a shape memory alloy connected to said deformable metal blade to deform said deformable metal blade to an extent which will cause said second contact to separate from said first contact when said control wire is heated to a given control temperature, said control temperature causing said wire to suddenly contract, pulling said deformable metal blade into a position where the second contact separates from said first contact, said control wire being positioned and connected in said circuit breaker to be initially heated to said control temperature by the flow of external circuit current through said circuit breaker when said first and second contacts are engaged, the degree to which the control wire is heated increasing with the magnitude of said external circuit current through the circuit breaker, and reaching said given control temperature when said current exceeds a given safe value for a given period of time; and e. a heat generating element coupled across said first and second contact so little current normally flows therethrough when said contacts are engaged, and having a resistance which limits current flow in said external circuit to a safe level when said contacts are disengaged, said heat generating element being in series with the external circuit, and said heat generating element being in heat conducting relation with said controlwire, such that when current flow therethrough is at said safe level, the heat conducted to said control wire from said heat generating element maintains the control wire at said given control temperature, wherein said contacts remain disengaged until said external circuit resistance returns to a safe level.

5. The circuit breaker of claim 4, wherein said deformable metal blade is constructed and positioned to be heated by said prolonged overload current, the heat generated in said deformable metal blade being the heat which is to heat said control wire to said control temperature when said prolonged overload current flows therethrough.

6. A resettable circuit breaker for protecting an electrical circuit from prolonged overload current conditions, said resettable breaker opening upon said prolonged overload current conditions, said breaker comprising:

a. a first stationary terminal having a first contact;

b. a movable terminal comprised of a single metal and having a second contact for engagement, under non-prolonged overload current conditions, with said first contact;

c. a second stationary terminal; and d. a shape memory alloy wire positioned adjacent said movable terminal, said shape memory alloy wire normally being in a relaxed, non-contracted condition;

wherein upon said prolonged overload current conditions, said shape memory alloy wire is heated and contracts, thereby contacting and shifting said movable terminal and said second contact out of engagement with said first contact of said first stationary terminal.

7. The resettable circuit breaker of claim 6, further comprising a fusible link connecting separate portions of said first stationary terminal.

* * * * *

UNITED STATES PATENT AND TRADEMARK OFFICE

CERTIFICATE OF CORRECTION

PATENT NO. : 5,420,561

DATED : May 30, 1995

INVENTOR(S) : Robert G. Swensen

It is certified that error appears in the above-indentified patent and that said Letters Patent is hereby corrected as shown below: On the title page, items [75] and [73]: should read Inventor, delete "C." and insert --G.--.

Assignee, delete "Littlefuse" and insert --Littelfuse--.

Signed and Sealed this

Fourteenth Day of November, 1995

*Attest:*

Bruce Lehman

BRUCE LEHMAN

*Attesting Officer*

*Commissioner of Patents and Trademarks*